US007008330B1

(12) United States Patent
Moulder

(10) Patent No.: US 7,008,330 B1
(45) Date of Patent: Mar. 7, 2006

(54) ROPE SWING HANDLE BAR APPARATUS AND SYSTEM

(76) Inventor: Terry K. Moulder, 3369 Barry La., Gainesville, GA (US) 30506

( * ) Notice: Subject to any disclaimer, the term of this patent is extended or adjusted under 35 U.S.C. 154(b) by 0 days.

(21) Appl. No.: 10/920,916

(22) Filed: Aug. 18, 2004

(51) Int. Cl.
*A63G 9/12* (2006.01)

(52) U.S. Cl. ..... 472/118; 472/121

(58) Field of Classification Search ..... 472/118–125; 403/34; 24/115 R, 128; 16/436, 428, 442; 482/24, 46, 98, 106–109, 139
See application file for complete search history.

(56) References Cited

U.S. PATENT DOCUMENTS 1,087,440 A * 2/1914 Freed ..... 182/11
1,322,956 A * 11/1919 Ruff ..... 24/122.6
1,748,426 A * 2/1930 Pentland ..... 280/748
1,870,748 A * 8/1932 Ramey ..... 472/118
2,722,209 A * 11/1955 Pillow ..... 123/185.4
2,914,018 A 11/1959 Schachner et al.
3,620,531 A * 11/1971 Larkin ..... 472/121
3,838,854 A * 10/1974 Hendrickson ..... 472/118
3,981,500 A 9/1976 Ryan
4,603,857 A 8/1986 Chipman et al.
4,717,147 A * 1/1988 Rochelle ..... 482/93
5,076,189 A 12/1991 Jones
5,108,090 A 4/1992 Reed
5,435,396 A * 7/1995 Robichaux ..... 172/378
5,453,032 A 9/1995 Crowe
5,706,900 A * 1/1998 Liao ..... 172/378

* cited by examiner

*Primary Examiner*—Kien Nguyen
(74) *Attorney, Agent, or Firm*—Greg O'Bradovich, Esq.; Myers & Kaplan, LLC

(57) ABSTRACT

A rope swing handle bar apparatus and system. The apparatus is centered on a cylindrical body through which a rope fits. The rope can generally be tied to a fixed object such as a tree branch. The handle bar typically includes handles having grips. The handles generally attached perpendicular to the cylindrical body. A washer is connected to one end of the body. A knot can be tied into the rope and the washer generally prevents the knot from becoming untied. The body is treated to prevent wear on the rope.

13 Claims, 2 Drawing Sheets

ROPE SWING HANDLE BAR APPARATUS AND SYSTEM

BACKGROUND

I. Field of the Invention

The present invention relates generally to the field rope swings and, more particularly, to a rope swing handle bar apparatus and system.

II. Description of the Related Art

Rope swings are commonly used for a variety of entertainment purposes. Typically, a user ties several knots into a rope and uses the rope for swinging. Typically, rope knots do not provide the best engagement with the rope because a user's hand can be pinched by the knot or can slip over the knot. Furthermore, direct engagement with the rope can cause rope burns on the user's hand or other parts of the body. Furthermore, it can be difficult for a user to engage the rope other than with the user's hands.

SUMMARY

In general, the invention features a rope swing handle bar apparatus and system. The apparatus is centered on a cylindrical body through which a rope fits. The rope can generally be tied to a fixed object such as a tree branch. The handle bar typically includes handle having grips. The handles generally attached perpendicular to the cylindrical body. A washer is connected to one end of the body. A knot can be tied into the rope and the washer generally prevents the knot from becoming untied. The body is treated to prevent wear on the rope.

In general, in one aspect, the invention features a rope swing apparatus, including a generally cylindrical body having an upper end and a lower end, a washer connected to the lower end and a handle connected to either side of the cylindrical body and in opposition to one another.

In one implementation, the apparatus further includes a channel through the cylindrical body.

In another implementation, the apparatus further includes an opening in the washer, the opening of the washer having a diameter matched to the diameter of the channel.

In another implementation, the upper is defined by an inner perimeter, the inner perimeter being chamfered.

In another implementation, the washer has an outer diameter greater than the diameter of the cylindrical body.

In another implementation, the washer includes an opening having an inner perimeter, the inner perimeter being chamfered.

In yet another implementation, the handles are connected generally perpendicular to the cylindrical body.

In still another implementation, the handles are connected adjacent the lower end.

In another implementation, the handles are located a first distance from the upper end and a second distance from the lower end.

In another implementation, the first distance is greater than the second distance.

In another implementation, the apparatus further includes grips on the outer ends of the handles.

In another implementation, the outer ends include an outer perimeter, the outer perimeter being chamfered.

In another implementation, the inner ends of the handles are bent inwards creating a bulge towards the upper and lower ends of the cylindrical body.

In another implementation, the bulges are reinforced by welds.

In another aspect, the invention features a rope swing system, including a rope swing apparatus, having a generally cylindrical body having an upper end and a lower end, and a channel defined therethough, a washer connected to the lower end having an opening with a diameter matched to the diameter of the channel, the washer further having an outer diameter larger than the outer diameter of the cylindrical body, thereby forming a wall, a handle connected to either side of the cylindrical body and in opposition to one another and a rope threaded through the channel and through the opening of the washer, the rope having a knot in contact with the wall of the washer.

In one implementation, the upper end includes a chamfered inner perimeter adapted to come into contact with the rope.

In another implementation, the opening in the washer includes an chamfered inner perimeter adapted to come into contact with the rope.

In another implementation, the chamfered perimeters prevent wearing and fraying of the rope.

One advantage of the invention is that it provides a strength-building exercise for children and adults alike.

Another advantage of the invention is that it provides a manageable handle for a rope swing.

Another advantage of the invention is that it allows a user to engage a rope swing without having to directly touch the rope.

Another advantage of the invention is that it helps to minimize rope burns associated with the use of rope swings.

Another advantage of the invention is that it aids in providing better engagement with a rope swing not achieved by gripping the rope or a knot in the rope alone.

Another advantage of the invention is that it allows the user to engage a rope swing other than with the user's hands, such as with the user's feet, legs and buttocks.

Other objects, advantages and capabilities of the invention will become apparent from the following description taken in conjunction with the accompanying drawings showing the preferred embodiment of the invention.

DETAILED DESCRIPTION

Figure 1:
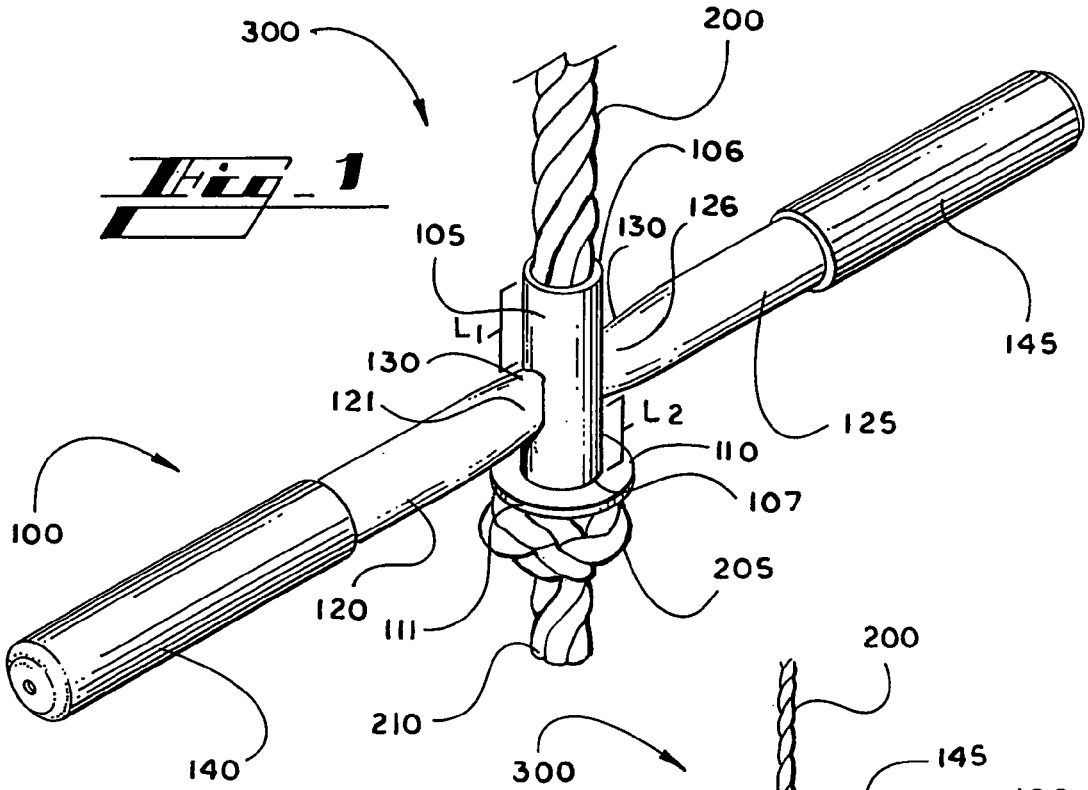
FIG. 1 illustrates a perspective view of a rope swing handle bar apparatus and system.

Referring to the drawings wherein like reference numerals designate corresponding parts throughout the several figures, reference is made first to FIG. 1 illustrates a perspective view of a rope swing handle bar apparatus 100 and system 300. The system 300 typically includes the apparatus 100 and a rope 200 threaded through the apparatus, secured by a knot 205. In general, the apparatus 100 includes a central cylindrical body 105. The cylindrical body 105 is generally hollow allowing the rope 200 to be threaded through the entirety of the cylindrical body 105. It is understood that other geometrical cross sections other than circular are contemplated for the body 105. However, it is further understood that the cylindrical body 105 is most logical to accommodate the rope 200. The cylindrical body 105 includes an upper end 106 and a lower end 107. A washer 110 having an outer diameter greater than the outer diameter of the cylindrical body 105 is connected to the lower end 107. The diameter of the opening of the washer 110 is matched to the diameter of the channel of the cylindrical body 105 to be able to provide a single continuous opening for the rope 200. The washer 110 provides a wall 111 with a generally large surface area that provides a surface onto which the knot 205 can rest and be pressed against during use. Therefore, the wall 111 prevents the knot 205 from becoming untied and actually helps to tighten the knot 205 during use. In addition, a short amount of excess rope 210 is shown below the washer 110. The user can have more or less excess rope 210 depending on preference and the like.

The apparatus 100 further includes handles 120, 125 connected to opposite sides on the outer surface of the cylindrical body 105. The handles 120, 125 are connected in opposition to provide a continuous handle support for the user as described further below. In addition, the handles 120, 125 are connected generally perpendicular to the cylindrical body 105. In general, the handles 120, 125 are much longer than the overall length of the cylindrical body 105. The handles 120, 125 being longer than the cylindrical body allows a greater torque to be applied on the handles 120, 125 by the user's weight in order to provide freedom of movement of the apparatus 100 during use. If the handles 120, 125 are too short, then a greater effort is required by the user to overcome the torque needed to twist the cylindrical body 105 with respect to the rope 200. In addition, each handle 120, 125 is connected to the cylindrical body adjacent the lower end 107 and the washer 107. Therefore, the length L1 between the handles 120, 125 and the upper end 106 is greater than the length L2 between the handles 120, 125 and the lower end 107. In general, the length differential between L1 and L2 aids in allowing the user to twist the apparatus 100 as needed. In general, by keeping L2 short compared to L1, the force of gravity of the user on the apparatus can be used to twist the apparatus 100 during use. If L2 becomes larger than L1, then the force of gravity is used against the user's efforts to twist the apparatus 100. In essence, L1 is the length of the fulcrum arm from the pivot point and fulcrum created at the intersection of the upper end 106 with the rope, with the weight of the user being provided at the end of that fulcrum arm. Therefore, the longer L1, the less force needed to provide a good torque on the cylindrical body. The shorter L1, the more force needed to create the same torque as described immediately above.

Each end 121, 126 of the handles 120, 125 are bent inward so that a portion of the ends 121, 126 bulges toward the upper end 106 and lower end 107 of the cylindrical body 105. This bulging provides additional support for the handle bars 120, 125 in their connection to the cylindrical body 105. The bulging 130 helps to prevent fatigue at the connection points between the handles 120, 125 and the cylindrical body. In a typical embodiment, the apparatus is formed of metal and therefore additional welds can be added at the connection point between the handles 120, 125 and the cylindrical body 105.

Each handle 120, 125 further includes grips 140, 145 for the user to grab during use. The grips 140, 145 are typically a material suitable for a comfortable and secure grip such as rubber.

It is appreciated that in general a variety of ropes with varying diameters can be used in the system 300. However, it is appreciated that if the diameter of the rope 200 becomes too small with respect to the diameter of the cylindrical body 105, the knot 205 may not be large enough and can be pulled through the washer 110 and the cylindrical body when a user engages the apparatus 100. Therefore, in general, it is appreciated that the diameter of the rope 200 should be close to the diameter of the cylindrical body 105 and opening in the washer 110.

Figure 2:
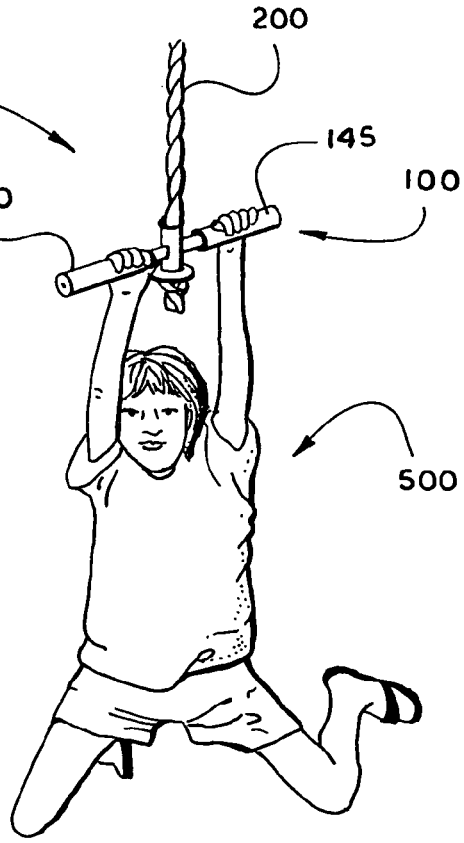
FIG. 2 illustrates a rope swing handle bar system in a typical use.

FIG. 2 illustrates a rope swing handle bar system 300 in a typical use. A user 500 is shown grasping the grips 140, 145 with her hands. The user 500 is therefore providing a gravitational force downwards on the apparatus 100 as described above. It is appreciated that the user 500 can engage the apparatus 100 is a variety of other ways, such as by placing the back of her knees on the handles 120, 125 and hanging upside down. The user 500 can also sit on the handles 120, 125 and grasp a portion of the rope with her hands. The user can also place her feet on the handles 120, 125 and stand on the apparatus 100. It is appreciated that there are a variety of ways that a user can engage the apparatus 100.

Figure 3:
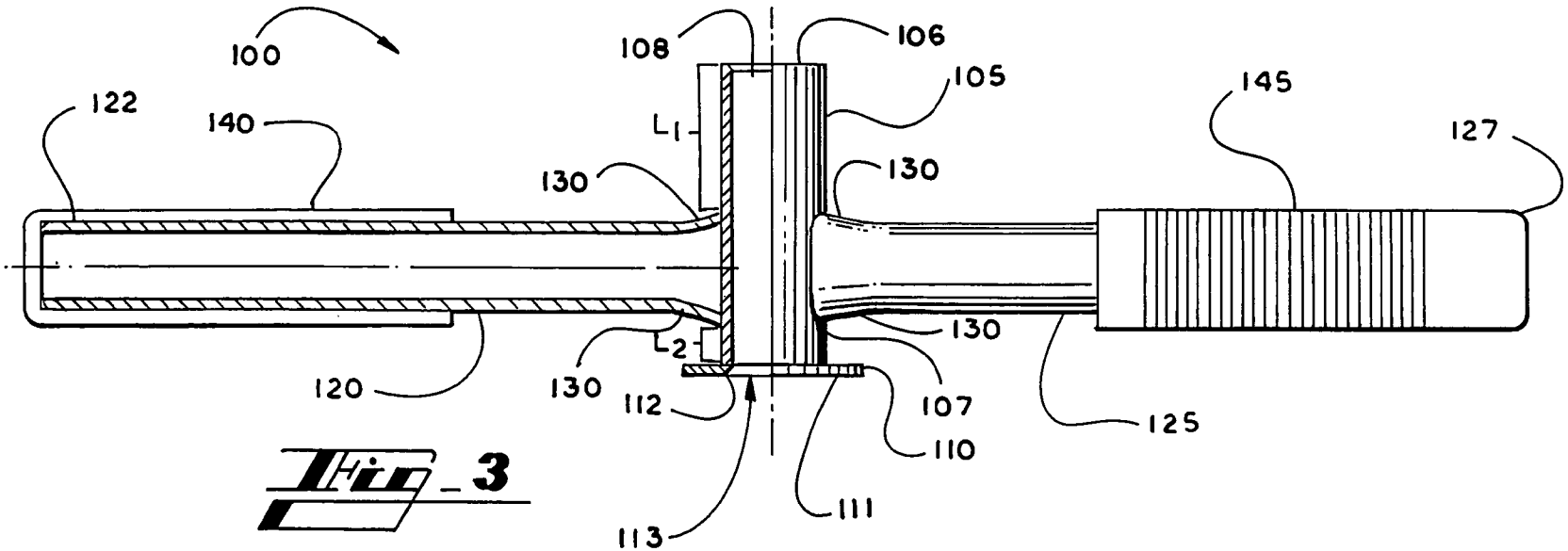
FIG. 3 illustrates a partial cut away side view of a rope swing handle bar apparatus.

FIG. 3 illustrates a partial cut away side view of a rope swing handle bar apparatus 100. As described above, the apparatus 100 includes the central cylindrical body 105 having an upper end 106 and a lower end 107. The partial cutaway view shown the channel 108 of the cylindrical body 105. The washer 110 having the wall 111 is connected to the lower end 107. The diameter of the opening of the washer 110 is matched to the diameter of the channel of the cylindrical body 105 to be able to provide a single continuous opening for the rope 200. The apparatus 100 further includes the handles 120, 125 connected to either side of the cylindrical body 105 creating a length differential between L1 and L2. Each end 121, 126 of the handles 120, 125 are bent inward so that a portion of the ends 121, 126 bulges toward the upper end 106 and lower end 107 of the cylindrical body 105. In this side view, the bulges 130 are further appreciated as bulging toward the upper and lower ends 106, 107 of the cylindrical body 105. The handles 120, 125 each include the grips 140, 145 for the user to grab during use.

One side of the apparatus 100 is shown in partial cutaway to appreciate further features of the apparatus 100. In general, the partial cutaway view illustrates that the handles 120, 125 are typically hollow. The hollow feature helps to minimize weight and to allow the bulges 130 to be easily created. Furthermore, the outer perimeter of the outer ends 122, 127 are chamferred in order to reduce sharp edges on the ends 122, 127. The main advantage of the chamfered ends 122, 127 is for easy placement of the grips 140, 145. With a sharp edge, the grips 140, 145 would be caught and snagged during placement. In addition, the chamfered ends 122, 127 prevent wear and tear on the inner portion of the grips 140, 145 during use.

The partial cutaway view further illustrates that the inner perimeter of the upper end 106 of the cylindrical body 105 is also chamfered. Furthermore, the inner perimeter 112 of the opening 113 of the washer 110 is also chamferred. Since the rope 200 comes into direct contact with the inner perimeter of the upper end 106 and the inner perimeter 112 of the washer 110, any significant edge can cause the rope 200 to tear and fray thus significantly reducing the useful life of the rope. The chamferring aids in prolonging the life of the rope. Therefore, the apparatus 100 is generally treated to protect the rope 200.

Figure 4:
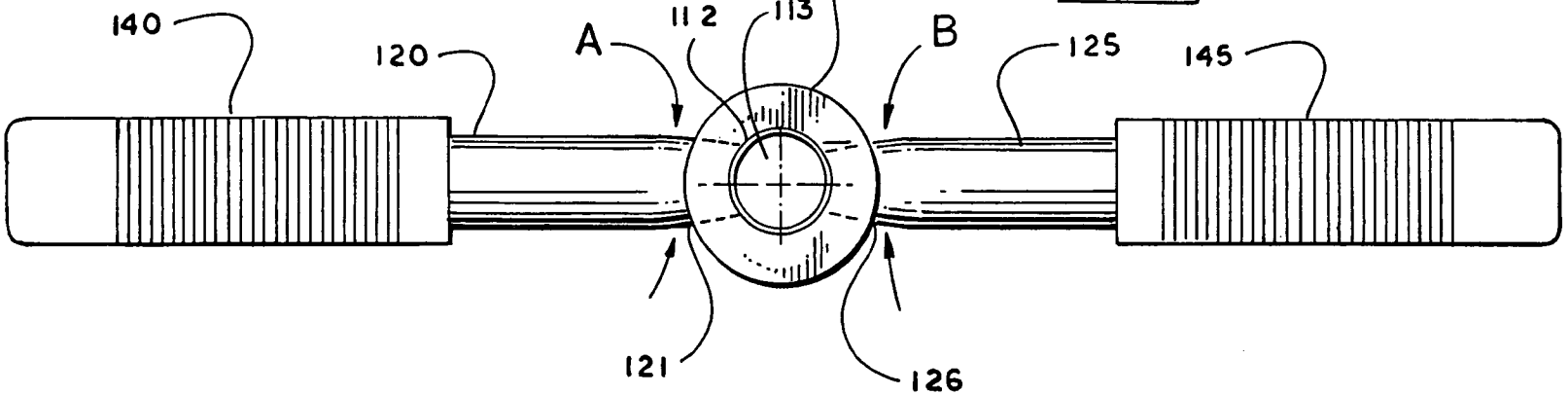
FIG. 4 illustrates a partial cut away bottom view of a rope swing handle bar apparatus.

FIG. 4 illustrates a partial cut away bottom view of a rope swing handle bar apparatus 100. This bottom view illustrates the washer 110, inner chamferred perimeter 112, the opening 133 of the washer and the channel 108 of the cylindrical body 105. As described above, the diameter of the opening

113 of the washer 110 is matched to the diameter of the channel 108 of the cylindrical body 105 to be able to provide a single continuous opening for the rope 200. The apparatus 100 further includes the handles 120, 125 connected to either side of the cylindrical body 105. The bottom view also gives an appreciation of the direction of the bends, as indicated by arrows A, B, on each end 121, 126 of the handles 120, 125 creating the bulges 130 as described above. The handles 120, 125 each include the grips 140, 145 for the user to grab during use.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A rope swing apparatus, comprising:

a generally cylindrical body having an upper end and a lower end;

a washer connected to the lower end;

a handle connected to either side of the cylindrical body and in opposition to one another, wherein the handles are connected generally perpendicular to the cylindrical body and adjacent the lower end;

a channel through the cylindrical body; and an opening in the washer, the opening of the washer having a diameter matched to the diameter of the channel.

2. The apparatus as claimed in claim 1 wherein the upper end is defined by an inner perimeter, the inner perimeter being chamfered.

3. The apparatus as claimed in claim 1 wherein the washer has an outer diameter greater than the diameter of the cylindrical body.

4. The apparatus as claimed in claim 1 wherein the washer includes an opening having an inner perimeter, the inner perimeter being chamfered.

5. The apparatus as claimed in claim 1 further comprising grips on the outer ends of the handles.

6. The apparatus as claimed in claim 5 wherein the outer ends include an outer perimeter, the outer perimeter being chamfered.

7. The apparatus as claimed in claim 1 wherein the inner ends of the handles are bent inwards creating a bulge towards the upper and lower ends of the cylindrical body.

8. The apparatus as claimed in claim 7 wherein the bulges are reinforced by welds.

9. A rope swing apparatus, comprising:

a generally cylindrical body having an upper end and a lower end;

a washer connected to the lower end; and a handle connected to either side of the cylindrical body and in opposition to one another, wherein the handles are connected generally perpendicular to the cylindrical body and located a first distance from the upper end and a second distance from the lower end and wherein the first distance is greater than the second distance.

10. A rope swing system, comprising:

a rope swing apparatus, having:

a generally cylindrical body having an upper end and a lower end, and a channel defined therethough;

a washer connected to the lower end having an opening with a diameter matched to the diameter of the channel, the washer further having an outer diameter larger than the outer diameter of the cylindrical body, thereby forming a wall;

a handle connected to either side of the cylindrical body and in opposition to one another; and a rope threaded through the channel and through the opening of the washer, the rope having a knot in contact with the wall of the washer.

11. The system as claimed in claim 10 wherein the upper end includes a chamfered inner perimeter adapted to come into contact with the rope.

12. The system as claimed in claim 11 wherein the opening in the washer includes an chamfered inner perimeter adapted to come into contact with the rope.

13. The system as claimed in claim 12 wherein the chamfered perimeters prevent wearing and fraying of the rope.

* * * * *